US007977856B2

(12) United States Patent
Hartmann et al.

(10) Patent No.: US 7,977,856 B2
(45) Date of Patent: Jul. 12, 2011

(54) SPARK PLUG INCORPORATING A FOLDED PACKING SITUATED ON AN OUTER CIRCUMFERENCE OF A HOUSING FOR POSITION-ORIENTED INSTALLATION

(75) Inventors: Detlef Hartmann, Bamberg (DE); Christoph Naumann, Grosshennersdorf (DE); Mario Fleischhauer, Poedeldorf (DE); Jochen Fischer, Bamberg (DE)

(73) Assignee: Robert Bosch GmbH, Stuttgart (DE)

( * ) Notice: Subject to any disclaimer, the term of this patent is extended or adjusted under 35 U.S.C. 154(b) by 131 days.

(21) Appl. No.: 12/456,225

(22) Filed: Jun. 11, 2009

(65) Prior Publication Data

US 2010/0007261 A1 Jan. 14, 2010

(30) Foreign Application Priority Data

Jul. 14, 2008 (DE) ..... 10 2008 040 386

(51) Int. Cl.
*H01T 13/02* (2006.01)
*H01T 13/04* (2006.01)
*H01T 13/08* (2006.01)

(52) U.S. Cl. ..... 313/135; 313/118; 313/141

(58) Field of Classification Search ..... 313/118–145; 123/169 EL
See application file for complete search history.

(56) References Cited

U.S. PATENT DOCUMENTS

| | | | | |
|---|---|---|---|---|
| 6,489,709 | B1 * | 12/2002 | Teramura et al. | 313/140 |
| 2004/0066124 | A1 * | 4/2004 | Kanao et al. | 313/135 |
| 2005/0127808 | A1 * | 6/2005 | Suzuki et al. | 313/118 |
| 2009/0085304 | A1 * | 4/2009 | Miyashita et al. | 277/591 |
| 2009/0102346 | A1 * | 4/2009 | Fukuzawa et al. | 313/135 |

FOREIGN PATENT DOCUMENTS

EP 1 039 601 9/2000

* cited by examiner

*Primary Examiner* — Mariceli Santiago
(74) *Attorney, Agent, or Firm* — Kenyon & Kenyon LLP

(57) ABSTRACT

A spark plug for an internal combustion engine includes a ground electrode, a center electrode, an insulator, a housing, and a folded packing which is situated on an outer circumference of the housing. The folded packing has: a hollow profile in cross section; a free leg directed outwards; and a support region. The folded packing lies on a contact surface in a support region, and the free leg is situated at an angle to the support region. The folded packing is pressed together during the mounting of the spark plug, and the free leg of the folded packing is designed to bend over in the direction of the support surface during the mounting to provide a diameter enlargement of the folded packing.

19 Claims, 2 Drawing Sheets

SPARK PLUG INCORPORATING A FOLDED PACKING SITUATED ON AN OUTER CIRCUMFERENCE OF A HOUSING FOR POSITION-ORIENTED INSTALLATION

BACKGROUND OF THE INVENTION

1. Field of the Invention

The present invention relates to a spark plug for position-oriented installation in an internal combustion engine.

2. Description of Related Art

Spark plugs in diversified embodiments are known from the related art. Known spark plugs are installed, for example, by screwing the spark plug into a cylinder head. While the spark plug is being screwed in, the tightening torque rises, and after a specified tightening torque is reached, the screwing process is stopped. This brings about a random orientation of the ground electrode in the combustion chamber. In modern internal combustion engines it is required, however, that ignition take place at predetermined positions in the combustion chamber, so that, in this context, the position of the ground electrode is also important. Based on this idea, it was proposed that one should arrange a screw thread in the cylinder head to have a specified alignment, so that, after the installation of the spark plug, there exists a defined position of the ground electrode in the combustion chamber. This, however, requires increased costs in the production of the screw thread. It was also determined that a predefined tightening torque cannot always be obtained, in this instance. In the case of too low a tightening torque, the connection between the spark plug and the cylinder head may not be gastight, in particular. In addition, there is the danger that the screw connection between spark plug and cylinder head becomes loose or unscrewed. Too high a tightening torque, however, may lead to excessive stress on the spark plug or on the cylinder head. A spark plug is known from EP 1 039 601 B1, for which a seal made of sheet metal is proposed, which is deformed during the screwing-in process, and which offers the possibility of orienting the spark plug in the cylinder head. In this case, however, sealing problems are particularly able to occur.

BRIEF SUMMARY OF THE INVENTION

The spark plug according to the present invention has the advantage that it is able to be tightened up to a required, specified tightening torque, and is then able to be additionally rotated further by a maximum of 180°, to achieve an alignment of the ground electrode. In the process, the spark plug according to the present invention ensures a sufficient gas tightness and also firm seating that is resistant to loosening. According to the present invention, this is achieved in that the spark plug has a folded packing that is situated at the outer circumference of a housing of the spark plug. The folded packing has a hollow profile in cross section so that, when a specified tightening torque is reached, it is able to be pressed together some more, in order still to make possible an alignment of the spark plug in the installed state, without there being disadvantages, because of this, with respect to gas tightness or the undesired loosening of the spark plug because of vibrations or the like. The folded packing extending around the outer circumference of the housing, has a free leg directed outwards and a support area, the free leg being situated at a predetermined angle to the support area. The free leg is designed in such a way that, upon insertion of the spark plug into a cylinder head, it bends over in the direction of the combustion chamber end of the spark plug. What this achieves is that when there is a further deformation of the folded packing based on a desired alignment of the spark plug after reaching the tightening torque, a tangential tensile stress occurs at the folded packing which particularly leads to an enlargement of the diameter of the folded packing. During this deformation process of the folded packing, a tightening torque remains essentially constant as a function of the tightening angle. Consequently, the folded packing ensures that, even after a specified tightening torque is reached, the spark plug is still able to be aligned, the tightening torque still remaining essentially constant during the alignment process. The folded packing ensures the required gas tightness, in this instance, and also the firm seating of the spark plug in the cylinder head.

It is advantageous if the hollow profile of the folded packing is closed in cross section. This ensures that, immediately after the specified tightening torque is reached, in response to further screwing of the spark plug into the cylinder head, an immediate deformation of the folded packing begins for achieving an alignment, at a practically constant tightening torque.

It is advantageous if the folded packing includes a region that is crimped over, which is in contact with the free leg on a side directed towards the inside of the folded packing. Because of this, and especially in response to the reforming of the folded packing, only a slight resistance is generated between the crimped-over region and the free leg, since the outer rounded region of the crimped-over region is in contact with the free leg.

It is also advantageous if the folded packing further includes an arched region and a straight connecting region. The free leg goes over into the support area, in this context. Furthermore, the support area goes over into the arched region and the arched region goes over into the straight connecting region. Moreover, the straight connecting region goes over into the crimped-over region. Since the crimped-over region touches the free leg, a closed hollow profile thus comes about. The folded packing is preferably made of a sheet metal material.

There is preferably an angle between the free leg and the support area of between 100° and 140°, and preferably of 120°.

There is preferably an angle between the straight connecting region and the support area of between 10° and 30°, and preferably of 20°.

According to one example embodiment of the present invention, there is an angle between the straight connecting region and the free leg of between 65° and 85°, and particularly preferred of ca. 75°.

The housing of the spark plug preferably has a recess to accommodate the folded packing. The recess has a radius, in this context, which is equivalent to an outer radius of the arched region of the folded packing or is larger or smaller by 10%. Thereby, in particular, a superb seal is achieved in the area of the folded packing.

It is further preferred if a screw thread region of the spark plug is situated closer to the end of the spark plug on the combustion chamber end than the folded packing. This allows an especially compact construction to be achieved.

According to one additional example embodiment of the present invention, the spark plug also includes an annular sealing element which ensures a seal between the spark plug and cylinder head. In this context, the sealing element is situated closer to the combustion chamber end of the spark plug than the folded packing. Because of the use of the additional sealing element, the folded packing is particularly able to have somewhat worse sealing properties, and may thus be produced more cost-effectively. However, if the folded packing still has sufficient sealing properties, then a redundant seal is achieved in this manner, according to the present invention. However, in the use of the sealing element, the folded packing is preferably designed in such a way that it assures a firm seating, resistant to being loosened, of the spark plug in the cylinder head.

The sealing element is preferably situated in the screw thread region of the spark plug. The sealing element then subdivides the screw thread region into two subsections. Alternatively, the sealing element is directly adjacent to a side of the screw thread region that faces away from the combustion chamber.

A continuous screw thread region is provided thereby which is particularly very easy and cost-effective to produce.

The sealing element is preferably produced from an elastic material, for instance, a plastic based on a silicone. Alternatively, the sealing element may also be produced from PTFE. In this context, during the mounting of the spark plug, the sealing element is pressed together or squeezed together, so that superb sealing properties are obtained.

DETAILED DESCRIPTION OF THE INVENTION

Figure 1:
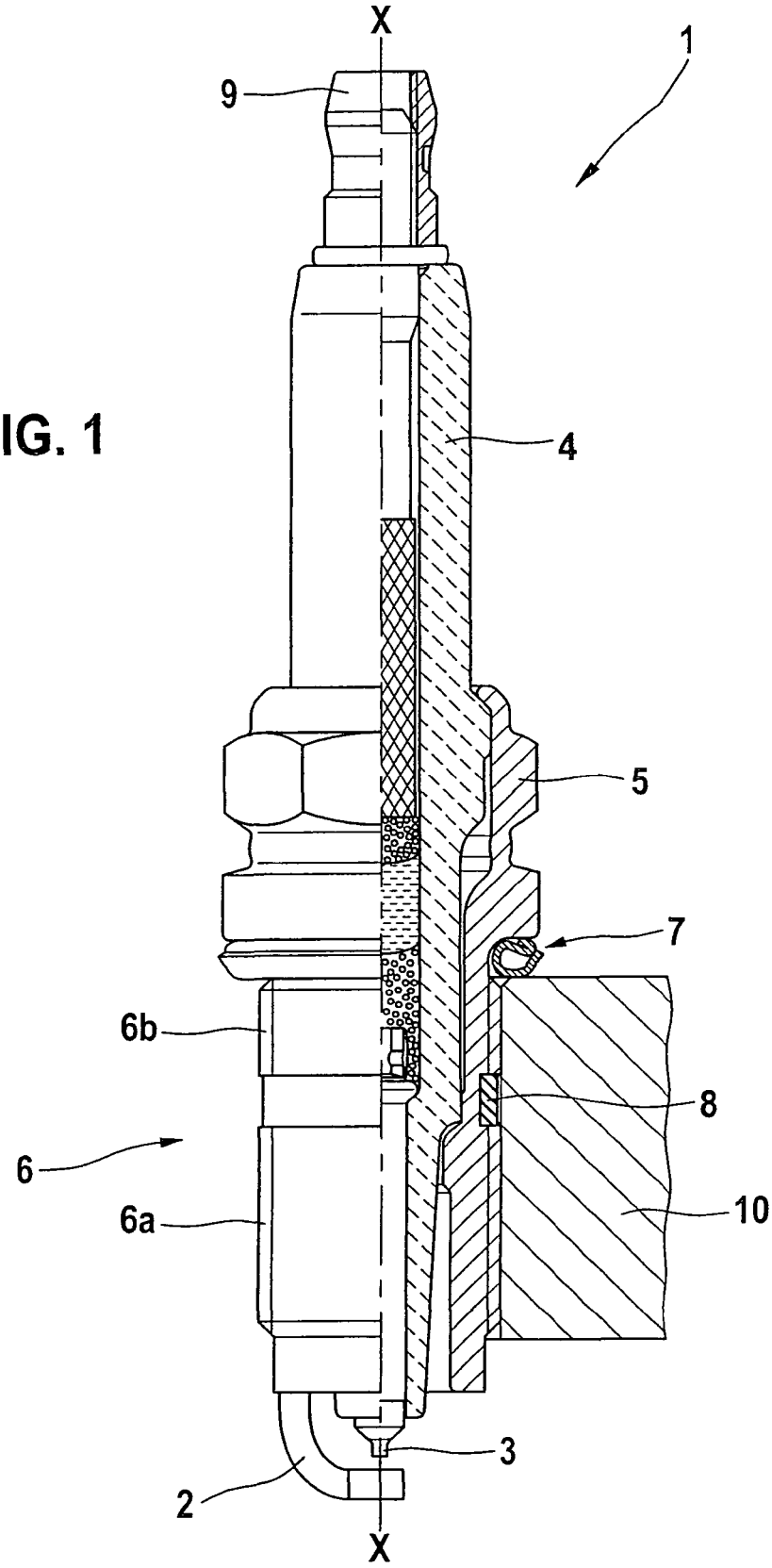
FIG. 1 shows a schematic, partially sectioned view of a spark plug according to an exemplary embodiment of the present invention.

As may be seen in FIG. 1, spark plug 1 includes a ground electrode 2, a center electrode 3 and an insulator 4. A housing 5 made of a metal surrounds insulator 4 at least partially. On housing 5 there is a screw thread 6 which is designed for fastening spark plug 1 in a cylinder head 10.

As may further be seen in FIG. 1, spark plug 1 includes a folded packing 7 and a separate, annular sealing element 8. Sealing element 8 is situated on housing 5 of screw thread 6, and it subdivides screw thread 6 into a first screw thread region 6*a* and a second screw thread 6 *b*. Sealing element 8, in this instance, is situated in an angular groove in housing 5, and has a rectangular shape in cross section, in its deformed state. Reference numeral 9 also designates an electric terminal for spark plug 1.

Figure 2:
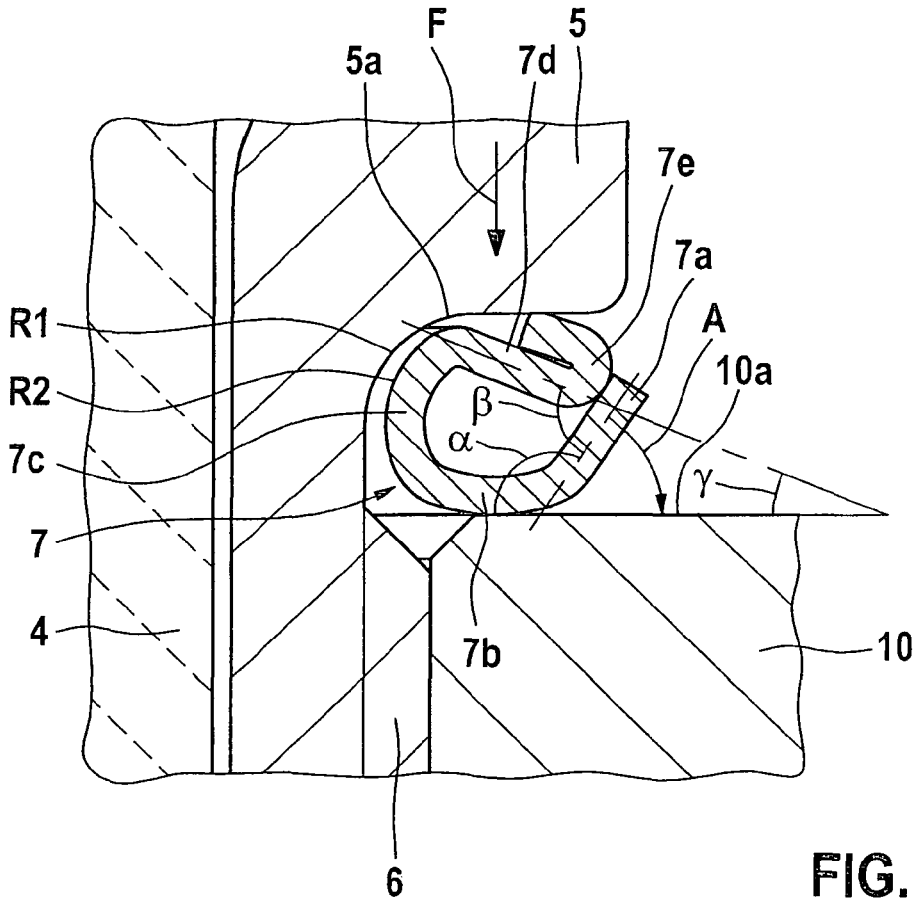
FIG. 2 shows a schematic, enlarged sectional view of a folded packing which is installed in the spark plug shown in FIG. 1.

FIG. 2 shows folded packing 7 in detail. Folded packing 7 has a closed hollow profile, in cross section, and is made of a sheet metal material. As shown in FIG. 2, folded packing 7 has a free leg 7*a*, a support region 7*b*, an arched region 7*c*, a straight connecting region 7*d* and a crimped-over region 7*e*. Free leg 7*a* goes over into support region 7*b*, support region 7*b* goes over into arched region 7*c*, arched region 7*c* goes over into straight connecting region 7*d* and the straight connecting region goes over into crimped-over region 7*e*. Crimped-over region 7*e* is crimped over outwards, in this context, so that one end of crimped-over region 7*e*, on its outside, is essentially parallel to straight connecting region 7*d*. As may be seen in FIG. 2, crimped-over region 7*e* is in contact with free leg 7*a*, in this instance. More accurately speaking, an outer arched surface of crimped-over region 7*e* is located in contact with a side at the end of free leg 7*a* that is directed towards the inside of folded packing 7. Because of this, free leg 7 is located slightly away from crimped-over region 7*e*, similar to a lower lip. In response to a deformation of folded packing 7, when spark plug 1 is screwed in, it is effected by a force F, directed in the axial direction, which then acts upon the folded packing, that free leg 7*a* bends over in the direction of a contact surface 10*a* of cylinder head 10. This is indicated in FIG. 2 by arrow A. In this context, FIG. 2 shows a state of folded packing 7 in which it has not yet been deformed. Contact surface 10*a* is in a plane that is perpendicular to the longitudinal axis X-X of the spark plug.

As may further be seen in FIG. 2, an angle $\alpha$ of ca. 120° is formed between free leg 7*a* and support region 7*b* or contact surface 10*a*. Moreover, an angle $\beta$ of ca. 75° is formed between straight connecting region 7*d* and free leg 7*a*. In addition, an angle $\gamma$ is established at ca. 20° between straight connecting region 7*d* and support region 7*b* or contact surface 10*a*.

Furthermore, an outside radius R2 of arched region 7*c* is equal to a radius R1 of a recess 5*a*, which is formed in housing 5. Recess 5*a* is used to accommodate folded packing 7 and is situated to be directly in connection with screw thread 6.

Figure 3:
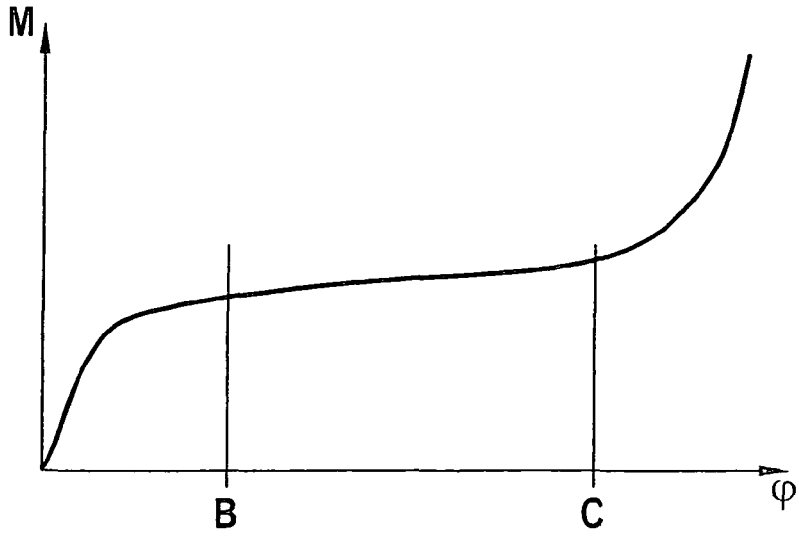
FIG. 3 shows a diagram of a tightening torque plotted against the tightening angle for the screwing in of the spark plug.

Consequently, when a force F acts on folded packing 7, particularly crimped-over region 7*e* and straight connecting region 7*d* are pressed perpendicularly in the direction of contact surface 10*a*. Since crimped-over region 7*e* is in contact with free leg 7*a*, free leg 7*a* is pressed towards contact surface 10*a* in the direction of arrow A. A reforming of folded packing 7 takes place, in this instance, particularly in such a way that an enlargement of the diameter comes about by the deformation of the regions of folded packing 7. A hollow space on the inside of folded packing 7 becomes steadily smaller in the process. When this occurs, in particular, pressure stress of folded packing 7 is able to be converted into a tangential tensile stress. This may also be seen in the diagram of FIG. 3, which shows a torque curve plotted against a tightening angle $\phi$. In this connection, the part of the curve between B and C denotes an angular range of 180°, in which alignment of the spark plug in cylinder head 10 is possible. As may be seen in FIG. 3, tightening torque M in this range is almost constant, so that, in particular, no damage to the spark plug takes place because of too high a tightening torque during the alignment process. It should be noted, in this connection, that tightening torque M is particularly proportional to prestress force F.

Thus, using folded packing 7, the spark plug according to the present invention may be screwed into a cylinder head 10 using a specified tightening torque, and then the alignment of the spark plug by at most 180° is able to take place without an undesired increase in the tightening torque. A pressure load of folded packing 7 is thereby converted into a tensile stress, so that the tightening torque is able to remain essentially constant during the alignment process. In this connection, folded packing 7 in particular represents a firm seat of spark plug 1 in cylinder head 10, which is not able to be loosened by vibrations and temperature change stresses or the like. Sealing element 8 ensures gastight sealing between a combustion chamber and the outside of spark plug 1. Thus, according to the present invention, a desired orientation of ground electrode 2 may be carried out, especially at right angles to a fuel flow in the combustion chamber, and overstressing of the spark plug, based on too high a tightening torque, may be avoided.

What is claimed is:

1. A spark plug for an internal combustion engine, comprising:

a ground electrode;

a center electrode;

an insulator;

a housing; and a folded packing situated on an outer circumference of the housing and having a hollow profile in cross section, wherein the folded packing includes a free leg directed outwards and a support region, the folded packing lying on a contact surface at the support region and the free leg being situated at an angle to the support region, the folded packing being pressed together during the mounting of the spark plug, and the free leg being configured to bend over in the direction of the contact surface during the mounting of the spark plug and provide a diameter enlargement of the folded packing, wherein the folded packing includes a crimped-over region in contact with the free leg at a side of the free leg directed towards the inside of folded packing, wherein the angle lies between the free leg and the support region in a range of 100 to 140 degrees.

2. The spark plug as recited in claim 1, wherein the hollow profile in cross section is closed.

3. The spark plug as recited in claim 1, wherein the folded packing further includes an arched region and a straight connecting region, and wherein the free leg extends over into the support region, the support region extends over into the arched region, the arched region extends over into the straight connecting region, and the straight connecting region extends over into the crimped-over region.

4. The spark plug as recited in claim 3, wherein the housing has a recess for accommodating the folded packing, the recess having a radius corresponding to an outer radius of the arched region of the folded packing.

5. The spark plug as recited in claim 1, further comprising a screw thread for fastening the spark plug situated on the housing, wherein the screw thread is situated closer to a combustion-chamber-side end of the spark plug than the folded packing.

6. A spark plug for an internal combustion engine, comprising:

a ground electrode;

a center electrode;

an insulator;

a housing; and a folded packing situated on an outer circumference of the housing and having a hollow profile in cross section, wherein the folded packing includes a free leg directed outwards and a support region, the folded packing lying on a contact surface at the support region and the free leg being situated at an angle to the support region, the folded packing being pressed together during the mounting of the spark plug, and the free leg being configured to bend over in the direction of the contact surface during the mounting of the spark plug and provide a diameter enlargement of the folded packing, wherein the folded packing includes a crimped-over region in contact with the free leg at a side of the free leg directed towards the inside of folded packing, wherein the folded packing further includes an arched region and a straight connecting region, and wherein the free leg extends over into the support region, the support region extends over into the arched region, the arched region extends over into the straight connecting region, and the straight connecting region extends over into the crimped-over region, wherein an angle lies between the straight connecting region and the support region in a range of 10 to 30 degrees.

7. The spark plug as recited in claim 6, wherein the hollow profile in cross section is closed.

8. The spark plug as recited in claim 6, wherein the folded packing further includes an arched region and a straight connecting region, and wherein the free leg extends over into the support region, the support region extends over into the arched region, the arched region extends over into the straight connecting region, and the straight connecting region extends over into the crimped-over region.

9. The spark plug as recited in claim 6, further comprising a screw thread for fastening the spark plug situated on the housing, wherein the screw thread is situated closer to a combustion-chamber-side end of the spark plug than the folded packing.

10. A spark plug for an internal combustion engine, comprising:

a ground electrode;

a center electrode;

an insulator;

a housing; and a folded packing situated on an outer circumference of the housing and having a hollow profile in cross section, wherein the folded packing includes a free leg directed outwards and a support region, the folded packing lying on a contact surface at the support region and the free leg being situated at an angle to the support region, the folded packing being pressed together during the mounting of the spark plug, and the free leg being configured to bend over in the direction of the contact surface during the mounting of the spark plug and provide a diameter enlargement of the folded packing, wherein the folded packing includes a crimped-over region in contact with the free leg at a side of the free leg directed towards the inside of folded packing, wherein the folded packing further includes an arched region and a straight connecting region, and wherein the free leg extends over into the support region, the support region extends over into the arched region, the arched region extends over into the straight connecting region, and the straight connecting region extends over into the crimped-over region, wherein an angle lies between the straight connecting region and the free leg in a range of 65 to 85 degrees.

11. The spark plug as recited in claim 10, wherein the hollow profile in cross section is closed.

12. The spark plug as recited in claim 10, wherein the folded packing further includes an arched region and a straight connecting region, and wherein the free leg extends over into the support region, the support region extends over into the arched region, the arched region extends over into the straight connecting region, and the straight connecting region extends over into the crimped-over region.

13. The spark plug as recited in claim 10, further comprising a screw thread for fastening the spark plug situated on the housing, wherein the screw thread is situated closer to a combustion-chamber-side end of the spark plug than the folded packing.

14. A spark plug for an internal combustion engine, comprising:

a ground electrode;

a center electrode;

an insulator;

a housing; and a folded packing situated on an outer circumference of the housing and having a hollow profile in cross section, wherein the folded packing includes a free leg directed outwards and a support region, the folded packing lying on a contact surface at the support region and the free leg being situated at an angle to the support region, the folded packing being pressed together during the mounting of the spark plug, and the free leg being configured to bend over in the direction of the contact surface during the mounting of the spark plug and provide a diameter enlargement of the folded packing, wherein the folded packing includes a crimped-over region in contact with the free leg at a side of the free leg directed towards the inside of folded packing, an annular sealing element situated closer to the combustion chamber-side-end of the spark plug than the folded packing.

15. The spark plug as recited in claim 14, wherein the sealing element is one of: a) situated in the vicinity of the screw thread and subdivides the screw thread into a first screw thread region and a second screw thread region; or b) situated at an end of the screw thread facing away from the combustion chamber, the sealing element being situated between the screw thread and the folded packing in the axial direction of the spark plug.

16. The spark plug as recited in claim 15, wherein the sealing element has a rectangular cross section.

17. The spark plug as recited in claim 14, wherein the hollow profile in cross section is closed.

18. The spark plug as recited in claim 14, wherein the folded packing further includes an arched region and a straight connecting region, and wherein the free leg extends over into the support region, the support region extends over into the arched region, the arched region extends over into the straight connecting region, and the straight connecting region extends over into the crimped-over region.

19. The spark plug as recited in claim 14, further comprising a screw thread for fastening the spark plug situated on the housing, wherein the screw thread is situated closer to a combustion-chamber-side end of the spark plug than the folded packing.

* * * * *